US011270665B2

(12) United States Patent
Lee

(10) Patent No.: US 11,270,665 B2
(45) Date of Patent: Mar. 8, 2022

(54) DISPLAY DEVICE AND METHOD FOR CONTROLLING BRIGHTNESS OF SAME

(71) Applicant: SAPIEN SEMICONDUCTORS INC., Ulsan (KR)

(72) Inventor: Jae Hoon Lee, Ulsan (KR)

(73) Assignee: SAPIEN SEMICONDUCTORS INC., Ulsan (KR)

( * ) Notice: Subject to any disclaimer, the term of this patent is extended or adjusted under 35 U.S.C. 154(b) by 0 days.

(21) Appl. No.: 17/050,948

(22) PCT Filed: Aug. 9, 2018

(86) PCT No.: PCT/KR2018/009077

§ 371 (c)(1),
(2) Date: Oct. 27, 2020

(87) PCT Pub. No.: WO2020/004704

PCT Pub. Date: Jan. 2, 2020

(65) Prior Publication Data

US 2021/0233491 A1 Jul. 29, 2021

(30) Foreign Application Priority Data

Jun. 28, 2018 (KR) ..... 10-2018-0074913

(51) Int. Cl.
*G09G 5/10* (2006.01)
*G09G 3/32* (2016.01)

(52) U.S. Cl.
CPC ..... *G09G 5/10* (2013.01); *G09G 3/32* (2013.01); *G09G 2300/026* (2013.01);
(Continued)

(58) Field of Classification Search
None
See application file for complete search history.

(56) References Cited

U.S. PATENT DOCUMENTS

2008/0129680 A1* 6/2008 Kimura ..... G09G 3/3426 345/102
2010/0302133 A1* 12/2010 Liang ..... G09G 3/3426 345/102

(Continued)

FOREIGN PATENT DOCUMENTS

JP 2017-215564 A 12/2017
KR 10-2008-0089792 A 10/2008

(Continued)

OTHER PUBLICATIONS

International Search Report for PCT/KR2018/009077 dated Mar. 22, 2019 (PCT/ISA/210).

*Primary Examiner* — Amr A Awad
*Assistant Examiner* — Donna V Bocar
(74) *Attorney, Agent, or Firm* — Sughrue Mion, PLLC

(57) ABSTRACT

Provided are a display device and a method of controlling a brightness of the display device.

The method of controlling a brightness of the display device according to an embodiment includes: applying first input image data to a display unit including a plurality of pixels to display a first image; detecting a brightness for each pixel from output image data of the first image displayed on the display unit, and extracting compensation pixels each having a brightness difference exceeding a reference value, the brightness difference being a difference between a detected brightness and a reference brightness; and generating compensation data of the compensation pixels based on the brightness differences of the compensation pixels.

2 Claims, 11 Drawing Sheets

(52) U.S. Cl.
CPC ..... *G09G 2320/029* (2013.01); *G09G 2320/0233* (2013.01); *G09G 2320/0285* (2013.01); *G09G 2320/045* (2013.01); *G09G 2320/0646* (2013.01); *G09G 2360/16* (2013.01)

(56) References Cited

U.S. PATENT DOCUMENTS

| | | | | |
|---|---|---|---|---|
| 2015/0130858 | A1* | 5/2015 | Ryu | G09G 3/3208 345/690 |
| 2017/0206825 | A1* | 7/2017 | Cha | G09G 3/3208 |
| 2020/0082788 | A1* | 3/2020 | Qiu | G09G 5/10 |
| 2020/0202770 | A1* | 6/2020 | Sawada | H01L 33/00 |

FOREIGN PATENT DOCUMENTS

| | | | |
|---|---|---|---|
| KR | 10-2012-0092982 | A | 8/2012 |
| KR | 10-2012-0135946 | A | 12/2012 |
| KR | 10-2017-0023614 | A | 3/2017 |

* cited by examiner

DISPLAY DEVICE AND METHOD FOR CONTROLLING BRIGHTNESS OF SAME

TECHNICAL FIELD

Embodiments of the present disclosure relate to a display device and a method of controlling a brightness of the display device.

BACKGROUND ART

Display devices have an issue that image quality distortion such as mura, etc. on a screen occurs due to a brightness variation caused by a variation in pixel characteristics, which occurs due to foreign matters generated in manufacturing processes or variations in the manufacturing processes, and/or a brightness variation caused by a variation in threshold voltages of transistors included in respective pixels, a change in a channel mobility, and/or deterioration of light-emitting elements.

DISCLOSURE

Technical Problem

Embodiments of the present disclosure provide a display device having a low-capacity memory integrated with a driving chip, so as to minimize increase in costs due to addition of a compensation circuit.

Technical Solution

According to an embodiment of the present disclosure, a method of controlling a brightness in a display device includes: applying first input image data to a display unit including a plurality of pixels to display a first image; detecting a brightness for each pixel from output image data of the first image displayed on the display unit, and extracting compensation pixels each having a brightness difference exceeding a reference value, the brightness difference being a difference between a detected brightness and a reference brightness; and generating compensation data of the compensation pixels based on the brightness differences of the compensation pixels.

The extracting of the compensation pixels may include: generating a brightness table by mapping a detected brightness of each pixel in the output image data to a location of the pixel; with respect to each pixel, setting a detected brightness of at least one adjacent pixel as the reference pixel; and extracting the pixels each having a brightness difference exceeding the reference value as the compensation pixels, the brightness difference being a difference between the detected brightness and the reference brightness.

The extracting of the compensation pixels may include: generating a brightness distribution chart of the output image data; setting a center brightness of the brightness distribution chart as the reference pixel; and extracting the pixels each having a brightness difference exceeding the reference value as the compensation pixels, the brightness difference being a difference between the detected brightness and the reference brightness.

The display device may further include a plurality of display units in connection with one another, and the method may further include receiving a global brightness of the output image data of the first image from each of the plurality of display units, and providing each of the plurality of display units with brightness correction data for correcting the global brightness differences of the plurality of display units.

The global brightness may be an average brightness or a center brightness of the output image data.

The method may further include applying third input image data that is obtained by correcting second input image data to the display unit to display a second image, by using the compensation data set with respect to the compensation pixels.

According to an embodiment of the present disclosure, a display device includes: a first controller applying first input image data to a display unit including a plurality of pixels; and a compensation unit detecting a brightness for each pixel from output image data of a first image displayed on the display unit by the first input image data, extracting compensation pixels each having a brightness difference exceeding a reference value, the brightness difference being a difference between a detected brightness and a reference brightness, and generating compensation data of the compensation pixels based on the brightness difference of the compensation pixels.

The compensation unit may generate a brightness table by mapping the detected brightness of each pixel in the output image data to a location of the pixel, may set a detected brightness of at least one adjacent pixel as the reference pixel for each pixel, and may extract the pixels each having a brightness difference exceeding the reference value as the compensation pixels, the brightness difference being a difference between the detected brightness and the reference brightness.

The compensation unit may generate a brightness distribution chart of the output image data, may set a center brightness of the brightness distribution chart as the reference brightness, and may extract pixels each having a brightness difference exceeding the reference value as the compensation pixels, the brightness difference being a difference between the detected brightness and the reference brightness.

The display device may further include: a plurality of display units in connection with one another; and a second controller receiving a global brightness of the output image data of the first image from each of the plurality of display units, and providing each of the plurality of display units with brightness correction data for correcting global brightness differences of the plurality of display units.

The global brightness may be an average brightness or a center brightness of the output image data.

The first controller may apply third input image data that is obtained by correcting second input image data to the display unit to display a second image, by using the compensation data set with respect to the compensation pixels.

Advantageous Effects

In a display device according to an embodiment of the present disclosure, an amount of compensation data is reduced and a low-capacity memory is integrated with a driving chip, and thus an increase in costs due to the addition of a compensation circuit may be minimized.

A multi-screen display device according to an embodiment of the present disclosure may provide a display device without loss of yield by performing a brightness correction in each of a plurality of display modules and a brightness correction among the display modules.

BEST MODE FOR DISCLOSURE

According to an embodiment of the present disclosure, a method of controlling a brightness in a display device includes: applying first input image data to a display unit including a plurality of pixels to display a first image; detecting a brightness for each pixel from output image data of the first image displayed on the display unit, and extracting compensation pixels each having a brightness difference exceeding a reference value, the brightness difference being a difference between a detected brightness and a reference brightness; and generating compensation data of the compensation pixels based on the brightness differences of the compensation pixels.

Mode for Disclosure

Since the present disclosure may apply various transformations and have various embodiments, specific embodiments will be illustrated in a diagram and described in detail in the detailed description. The effects and features of the present disclosure, and a method of achieving them, will be clarified with reference to the embodiments described later in detail together with diagrams. However, the present disclosure is not limited to the embodiments disclosed below and may be implemented in various forms.

Hereinafter, embodiments of the present disclosure will be described in detail with reference to attached diagrams, and when describing with reference to diagrams, the same or corresponding constituent elements are assigned the same diagram symbol, and redundant descriptions thereof will be omitted.

In the following embodiments, terms such as first and second are used for distinguishing one constituent element from other constituent elements. These constituent elements should not be limited by these terms. In addition, in the following embodiments, expressions in the singular include plural expressions unless the context clearly indicates otherwise.

In the following embodiments, terms such as include or have means that the features or elements described in the specification are present, and do not preclude the possibility that one or more other features or elements may be added.

Figure 1:
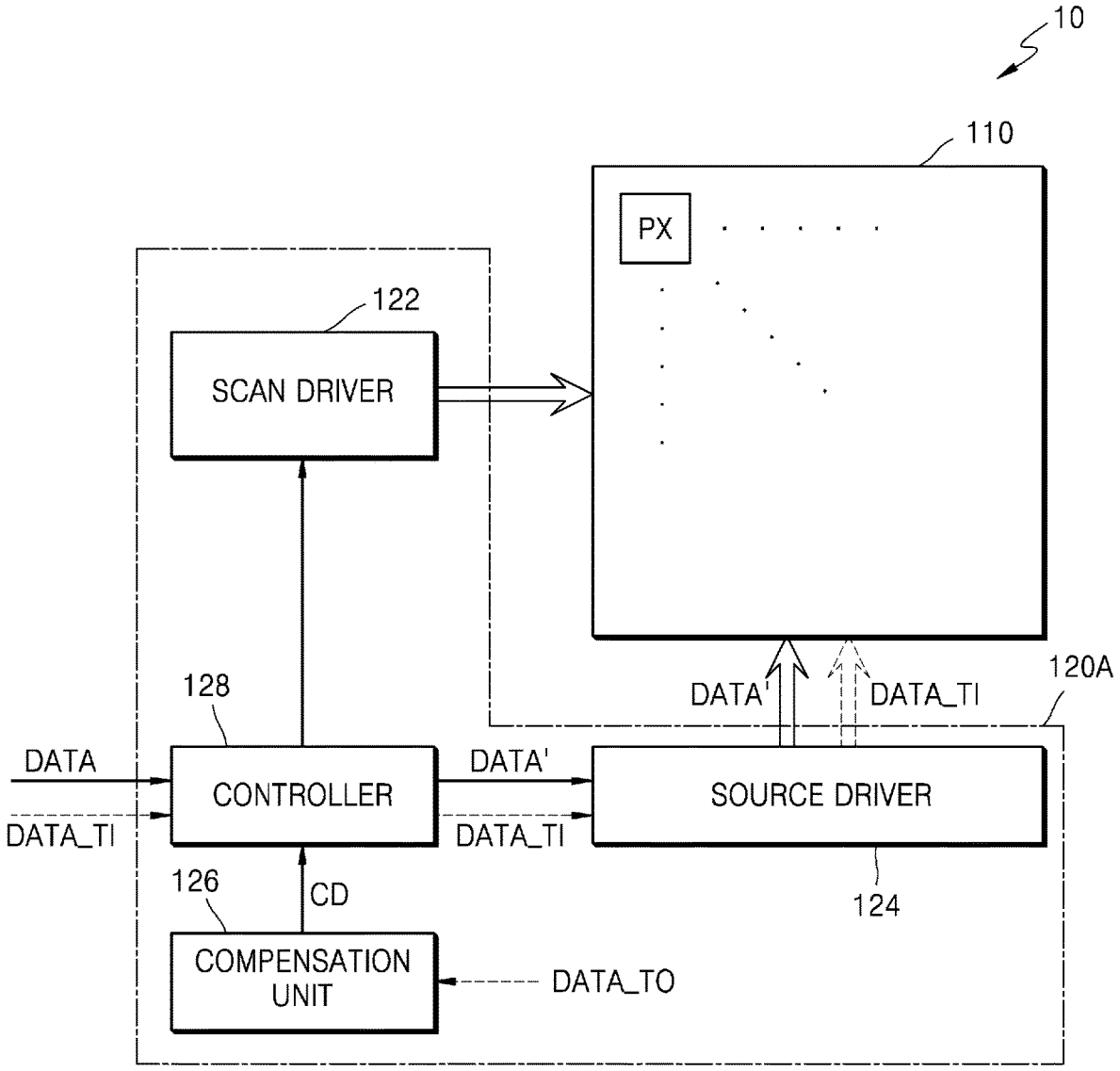
FIG. 1 is a schematic block diagram of a display device according to an embodiment of the present disclosure.
Figure 2:
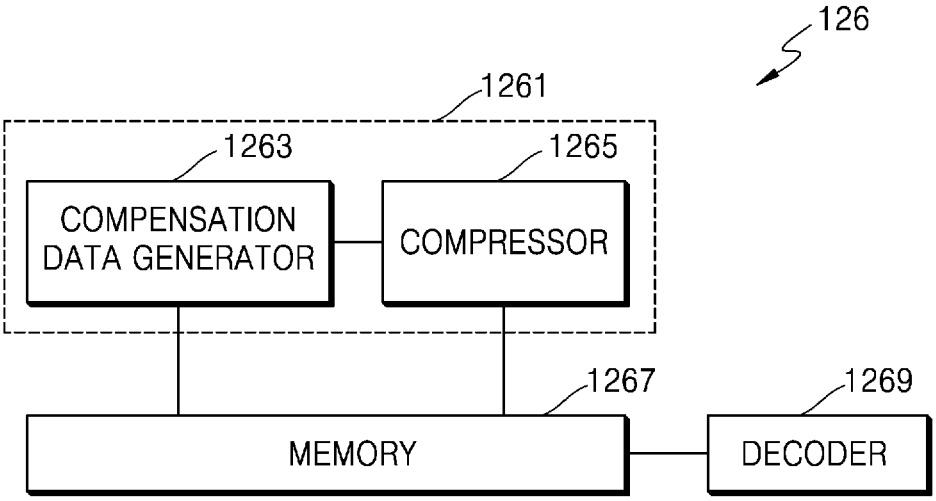
FIG. 2 is a block diagram schematically showing a compensation unit of FIG. 1.
Figure 3:
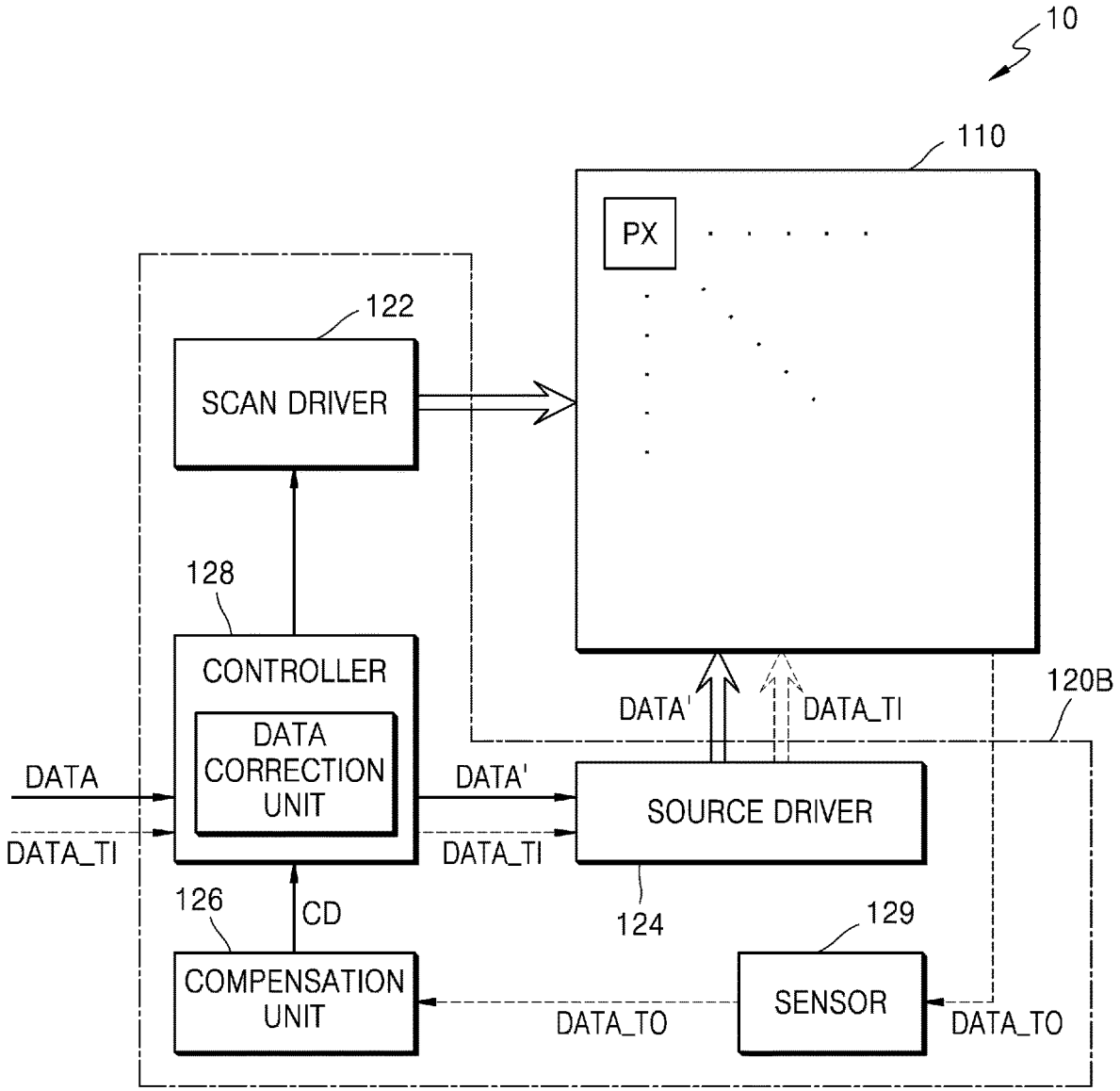
FIG. 3 is a schematic block diagram of a display device according to another embodiment of the present disclosure.

FIG. 1 is a schematic block diagram of a display device according to an embodiment of the present disclosure. FIG. 2 is a block diagram schematically showing a compensation unit of FIG. 1. FIG. 3 is a schematic block diagram of a display device according to another embodiment of the present disclosure.

Referring to FIG. 1, a display device 10 according to an embodiment may include a display unit 110 and a driver 120A.

The display unit 110 may include a plurality of pixels PX arranged in a certain pattern, for example, a matrix-type pattern or a zigzag-type pattern. Each of the pixels PX emits light of a single color, for example, may emit one of red light, blue light, green light, and white light. The pixel PX may emit light of a color other than red, blue, green, and white.

The pixel PX may include a light-emitting element. The light-emitting element may be a self-emissive element. For example, the light-emitting element may be a light emitting diode (LED). The light-emitting element may include an LED having a micro to nano-unit size. The LED may emit light having a single peak wavelength or light having a plurality of peak wavelengths. The LED may selectively include an LED chip, a fluorescent layer on an LED chip, or an LED package in which an LED chip is packaged. The fluorescent layer may emit one or more peak wavelengths emitted from the LED chip.

The pixel PX may further include a pixel circuit connected to the light-emitting element. The pixel circuit may include at least one thin film transistor and at least one capacitor. The pixel circuit may be implemented by a semiconductor stack structure in an LED chip.

The driver 120A may include a scan driver 122, a source driver 124, a compensation unit 126, and a controller 128. The driver 120A may be implemented as a system on chip (SOC) processor and may be electrically connected to the display unit 110. The SOC processor denotes an integrated circuit (IC) in which a micro-processor, a built-in memory, a plurality of peripheral devices, an external bus interface, etc. are loaded on one chip.

The scan driver 122 is connected to a plurality of scan lines connected to the pixels PX of the display unit 110, and may apply a scan signal to the scan lines.

The source driver 124 is connected to a plurality of data lines connected to the pixels PX of the display unit 110, and may convert image data DATA', of which brightness has been corrected, transmitted from the controller 128 into a signal in the form of voltage or current and may apply the signal to the data lines.

The compensation unit 126 may provide the controller 128 with data (hereinafter, referred to as 'compensation data CD') for correcting a brightness of input image data DATA (raw data). The compensation unit 126 may generate and store the compensation data CD in advance. The compensation unit 126 may extract a pixel that needs a brightness correction (hereinafter, referred to as 'compensation pixel') through a brightness analysis of a test image, and may generate compensation data CD of the compensation pixel based on the brightness of the test image. The compensation data CD may include a difference between a brightness of the compensation pixel and a reference brightness or brightness correction data that is generated based on the brightness difference. The compensation unit 126 may reduce a memory capacity in the driver 120A by storing only the compensation data of the compensation pixel, not the compensation data of entire pixels.

The controller 128 may generate a scan control signal and a data control signal and may transfer the scan control signal and the data control signal respectively to the scan driver 122 and the source driver 124. The controller 128 receives the input image data DATA from outside (e.g., a graphic controller), and then may transfer the corrected image data DATA' to the source driver 124, wherein the corrected image data DATA' is obtained by correcting a brightness of the input image data DATA by using the compensation data CD. The controller 128 may convert the input image data DATA into the corrected image data DATA' by using the compensation data CD.

Although not shown in the drawings, the driver 120A may further include a power supply unit that receives external power and/or internal power to convert the power into voltages of various levels, which are necessary for operating the elements, and supplies the corresponding voltage to the display unit 110 according to control of the controller 128.

Referring to FIG. 2 together, the compensation unit 126 may include an encoder 1261, a memory 1267, and a decoder 1269.

The encoder 1261 may include a compensation data generator 1263 and a compressor 1265.

The compensation data generator 1263 may extract the compensation pixel and generate the compensation data CD of the compensation pixel. The compensation data generator 1263 may extract the compensation pixel based on a brightness of output test data DATA_TO of the test image displayed on the display unit 110, and may generate the compensation data CD of the compensation pixel.

The test image is displayed on the display unit 110 when the controller 128 receives input test data DATA_T from the outside and transfers the input test data DATA_T to the source driver 124 and the source driver 124 converts the input test data DATA_T into a signal in the form of voltage or current and applies the signal to the data lines. The test image may include mura that occurs due to a brightness variation caused by foreign matters remaining on the display unit 110, a variation in threshold voltages of the transistors included in respective pixels, a change in a channel mobility, and/or deterioration of light-emitting elements.

In an embodiment, the output test data DATA_TO of the test image may be image data obtained by using an imaging device that captures the test image. The imaging device may include a camera. The camera may transfer the image data of a captured image of the test image displayed on the display unit 110, that is, the output test data DATA_TO, to the compensation data generator 1263.

In another embodiment, the output test data DATA_TO of the test image may be obtained when, as shown in FIG. 3, a sensor 129 included in a driver 120B reads out the image data of the test image displayed on the display unit 110. In this case, the display unit 110 may include a plurality of sensing lines connected to the pixels PX.

The compensation data generator 1263 detects a brightness of each pixel from the output test data DATA_TO, and may calculate a difference between the detected brightness of each pixel and a reference brightness.

The compensation data generator 1263 may extract a pixel, in which the brightness difference exceeds a reference value, as the compensation pixel.

The compensation data generator 1263 may generate the compensation data CD of the compensation pixel. The compensation data CD may include a brightness difference between the detected brightness and the reference brightness. Alternatively, the compensation data CD may include a brightness correction value for compensating for the brightness difference.

In an embodiment, the compensation data generator 1263 may store the compensation data CD for each compensation pixel in the memory 1267. According to an embodiment of the present disclosure, the compensation data of all the pixels is not generated and stored in the memory, and thus, the memory capacity may be reduced.

In another embodiment, the compensation data generator 1263 may compress the compensation data CD for each compensation pixel in the compressor 1265 and then, may store the compressed data in the memory 1267. According to the embodiment, the memory capacity may be further reduced through the data compression. The compression method is not particularly restricted.

The memory 1267 may store the compensation data CD for each compensation pixel or the compressed compensation data CD for each compensation pixel. The memory 1267 may include a non-volatile memory, for example, a read only memory (ROM) or an electrically erasable programmable read only memory (EEPROM) in which the data may be updated and erased.

The decoder 1269 reads and uncompresses the compensation data CD of the compensation pixel stored in the memory 1267, and then, outputs the compensation data CD to the controller 128.

The generation and storing of the compensation data according to the embodiment of the present disclosure may be performed at a certain cycle in a pre-shipment inspection stage of the display device after being manufactured, and/or during utilization of the display device after the shipment.

Figure 4:
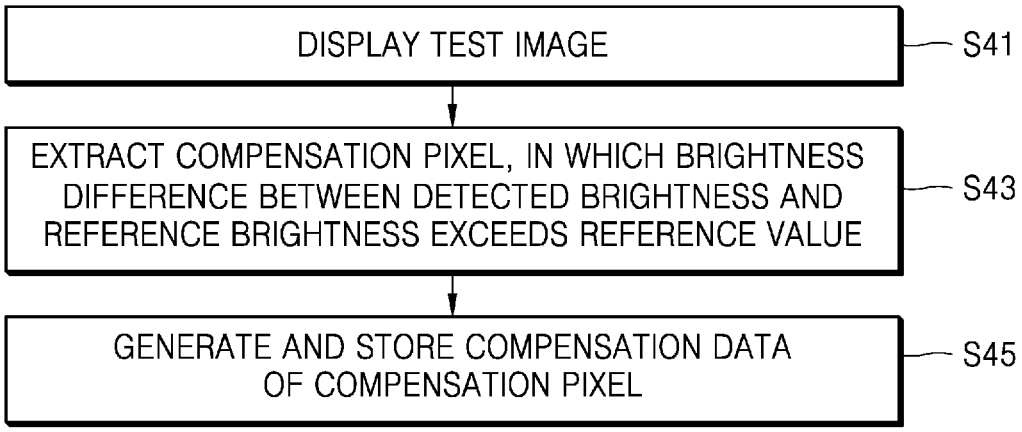
FIG. 4 is a flowchart schematically describing a method of generating compensation data according to an embodiment of the present disclosure.

FIG. 4 is a flowchart schematically illustrating a method of generating compensation data according to an embodiment of the present disclosure.

Referring to FIG. 4, the controller 128 receives the input test image data from the outside and controls the scan driver 122 and the source driver 124 to apply the input test image data to the pixels PX of the display unit 110, and thus, the test image may be displayed on the display unit 110 (S41).

The compensation data generator 1263 obtains output test image data from the test image, and may extract a compensation pixel based on a difference between a detected brightness of each pixel and a reference brightness (S43). The compensation data generator 1263 may detect the brightness of each pixel from the output test image data. The compensation data generator 1263 calculates the difference between the detected brightness and the reference brightness for each pixel, and may extract a pixel, in which the brightness difference exceeds a reference value, as a compensation pixel.

The compensation data generator 1263 may generate compensation data CD of the compensation pixel based on the brightness difference and may store the compensation data CD in the memory (S45). The compensation data generator 1263 may store the compensation data CD in the memory after compressing the compensation data CD.

Figure 5:
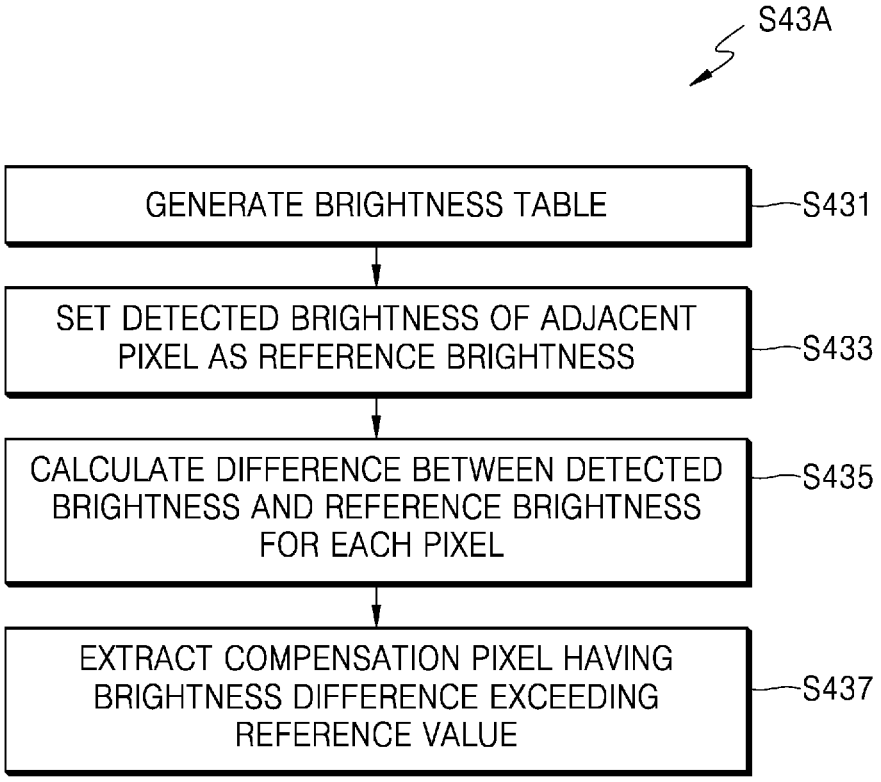
FIG. 5 is a flowchart schematically describing a method of extracting a compensation pixel of FIG. 4 according to an embodiment.

FIG. 5 is a flowchart schematically describing a method of extracting a compensation pixel of FIG. 4 according to an embodiment.

Referring to FIG. 5, the compensation data generator 1263 may generate a brightness table indicating a brightness of each pixel (S431). The compensation data generator 1263 may generate a brightness table of the test image by mapping the brightness of each pixel to a location of the corresponding pixel. The brightness table may have a size that is the same as a resolution of the display unit 110.

The compensation data generator 1263 may set a reference brightness for each pixel in the brightness table (S433). The reference brightness may be a detected brightness of at least one of adjacent pixels in upper, lower, left, right, and diagonal directions within a certain range (e.g., n×n window). A location of the adjacent pixel for determining the reference brightness may be determined in advance. The reference brightness may be set as an average brightness of two or more adjacent pixels.

The compensation data generator 1263 may calculate a difference between the detected brightness and the reference brightness for each pixel (S435).

Figure 6:
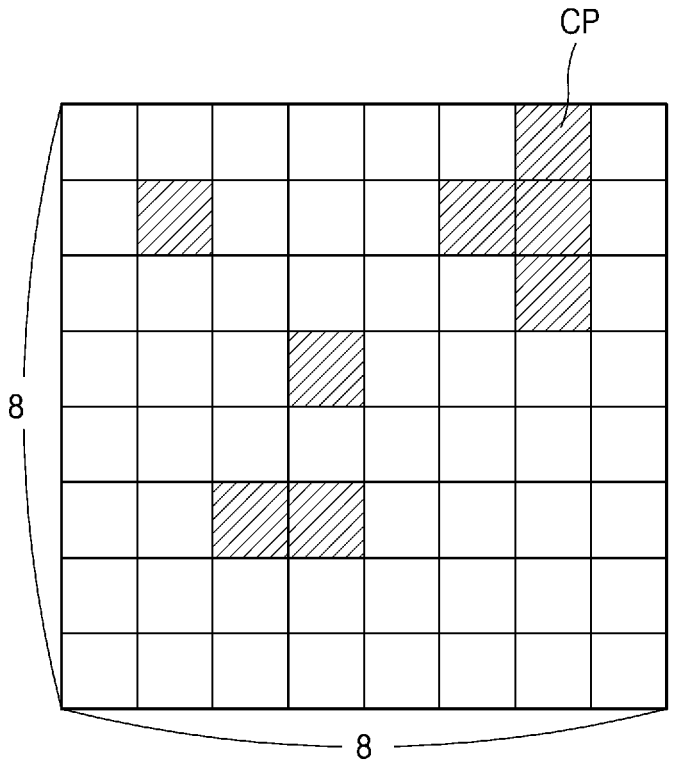
FIG. 6 is a diagram exemplary showing a location of a compensation pixel that is extracted by using an 8×8 brightness variation table generated with respect to a test image, in a display device having 8×8 pixel arrangement.

The compensation data generator 1263 may extract a pixel, in which the brightness difference exceeds a reference value, as the compensation pixel (S437). FIG. 6 is a diagram exemplary showing a location of a compensation pixel CP that is extracted by using a 8×8 brightness variation table generated with respect to a test image, in a display device having 8×8 pixel arrangement.

The compensation data generator 1263 may generate the compensation data based on a difference between the brightness of the compensation pixel and an average brightness of the test image. For example, the compensation data may denote the difference between the brightness of the compensation pixel and the average brightness of the test image.

Figure 7:
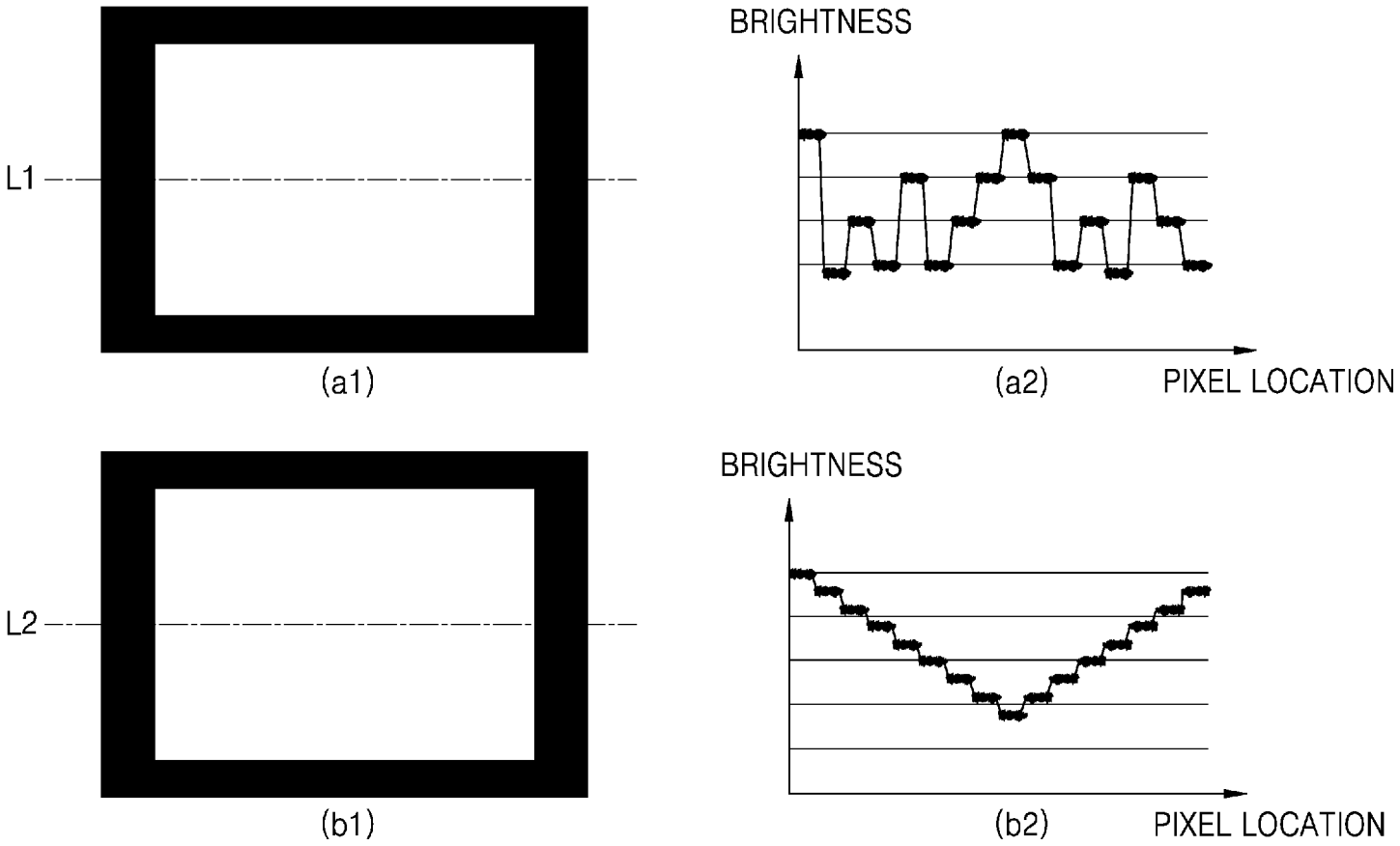
FIG. 7 is a diagram for describing a method of extracting a compensation pixel according to FIG. 5.

FIG. 7 is a diagram for describing a method of extracting a compensation pixel according to FIG. 5.

In FIG. 7, (a1) at the left shows a first test image of a certain gray scale (e.g., 255 gray scales) displayed on a first display device, and (a2) at the right is a graph showing brightness measured along a certain line in the first test image. In the graph at the right side, an x-axis denotes a pixel location and a y-axis denotes a brightness.

In the brightness graph of FIG. 7 (a2), a brightness difference between adjacent blocks in the first test image exceeds a reference value. A driver of the first display device may extract a correction pixel that needs to correct the brightness thereof such that the brightness difference between adjacent pixels does not exceed the reference value in the first test image, and may generate and store correction data of the correction pixel.

In FIG. 7, (b1) at the left shows a second test image of a certain gray scale (e.g., 255 gray scales) displayed on a second display device, and (b2) at the right is a graph showing brightness measured along a certain line L2 in the second test image. In the graph at the right side, an x-axis denotes a pixel location and a y-axis denotes a brightness.

In the brightness graph of (b2) in FIG. 7, a brightness difference between adjacent blocks in the second test image is less than a reference value. In this case, even when a difference between a brightness of a pixel located on a center of the line L2 and the highest brightness in the line L2 exceeds the reference value, a brightness correction is not necessary because a brightness difference between adjacent pixels is less than the reference value.

Figure 8:
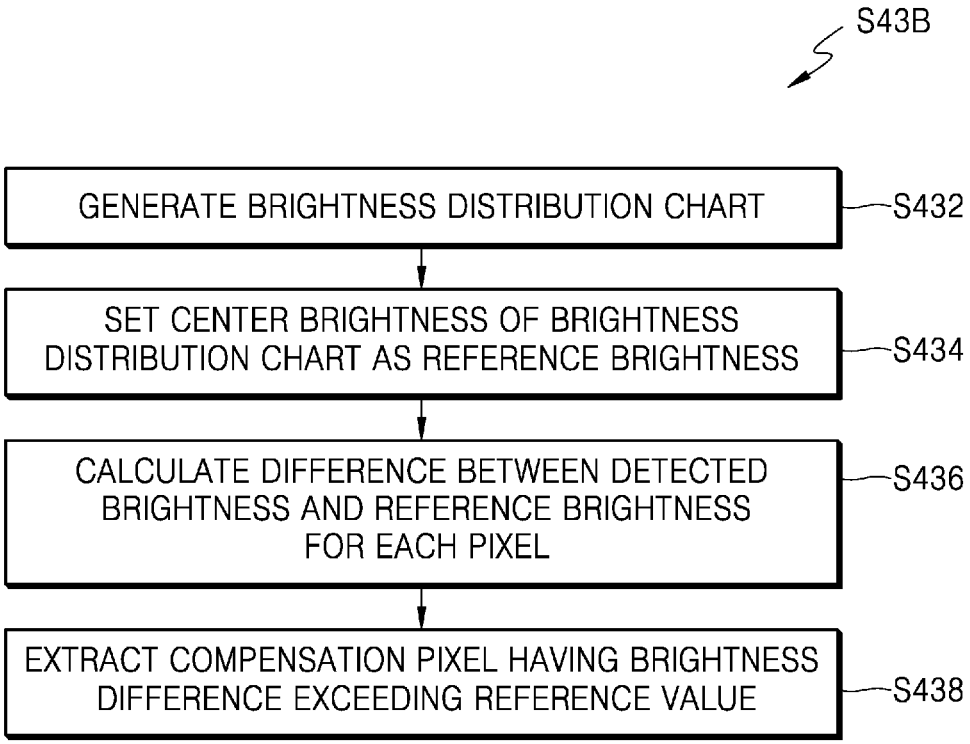
FIG. 8 is a flowchart schematically describing a method of extracting a compensation pixel of FIG. 4 according to another embodiment.

FIG. 8 is a flowchart schematically describing a method of extracting a compensation pixel of FIG. 4 according to another embodiment.

Figure 9:
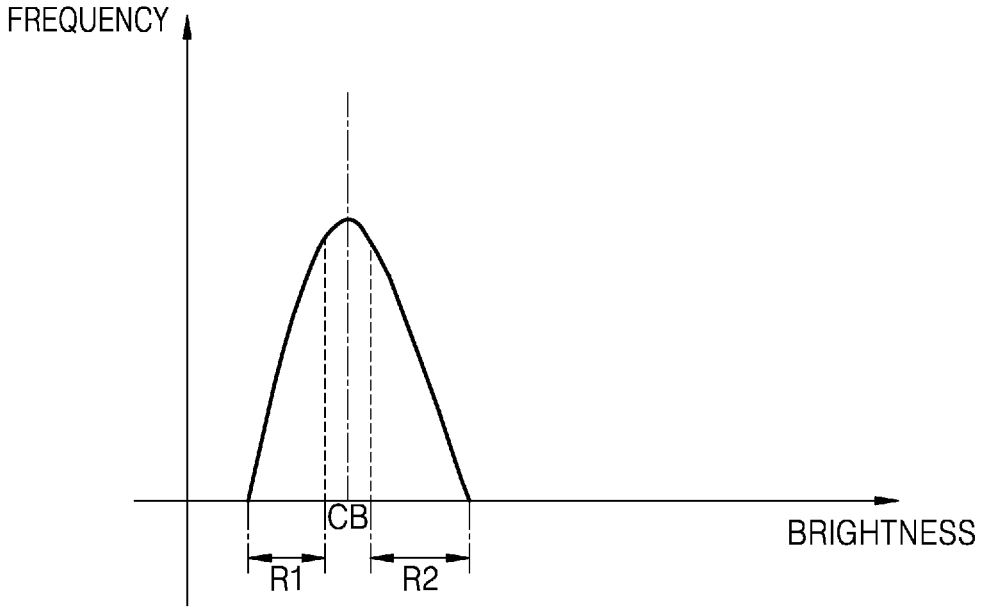
FIG. 9 is an exemplary diagram showing a brightness distribution chart of a test image.

Referring to FIG. 8, the compensation data generator 1263 may generate a brightness distribution chart representing brightness distribution in the test image (S432). The compensation data generator 1263 may generate a brightness distribution chart of the test image, representing the number of pixels (frequency) for each brightness level. FIG. 9 is an exemplary diagram of a brightness distribution of a test image.

The compensation data generator 1263 may set a center brightness CB at which the frequency is the largest in the brightness distribution chart as a reference brightness (S434).

The compensation data generator 1263 may calculate a difference between the detected brightness and the reference brightness for each pixel (S436).

The compensation data generator 1263 may extract a pixel, in which the brightness difference exceeds a reference value, as the compensation pixel (S438). In FIG. 9, the pixels having the brightness within brightness ranges of R1 and R2 may be extracted as the compensation pixels.

The compensation data generator 1263 may generate the compensation data based on a difference between the brightness of the compensation pixel and a center brightness CB of the test image. For example, the compensation data may denote the difference between the brightness of the compensation pixel and the center brightness CB of the test image.

Figure 10:
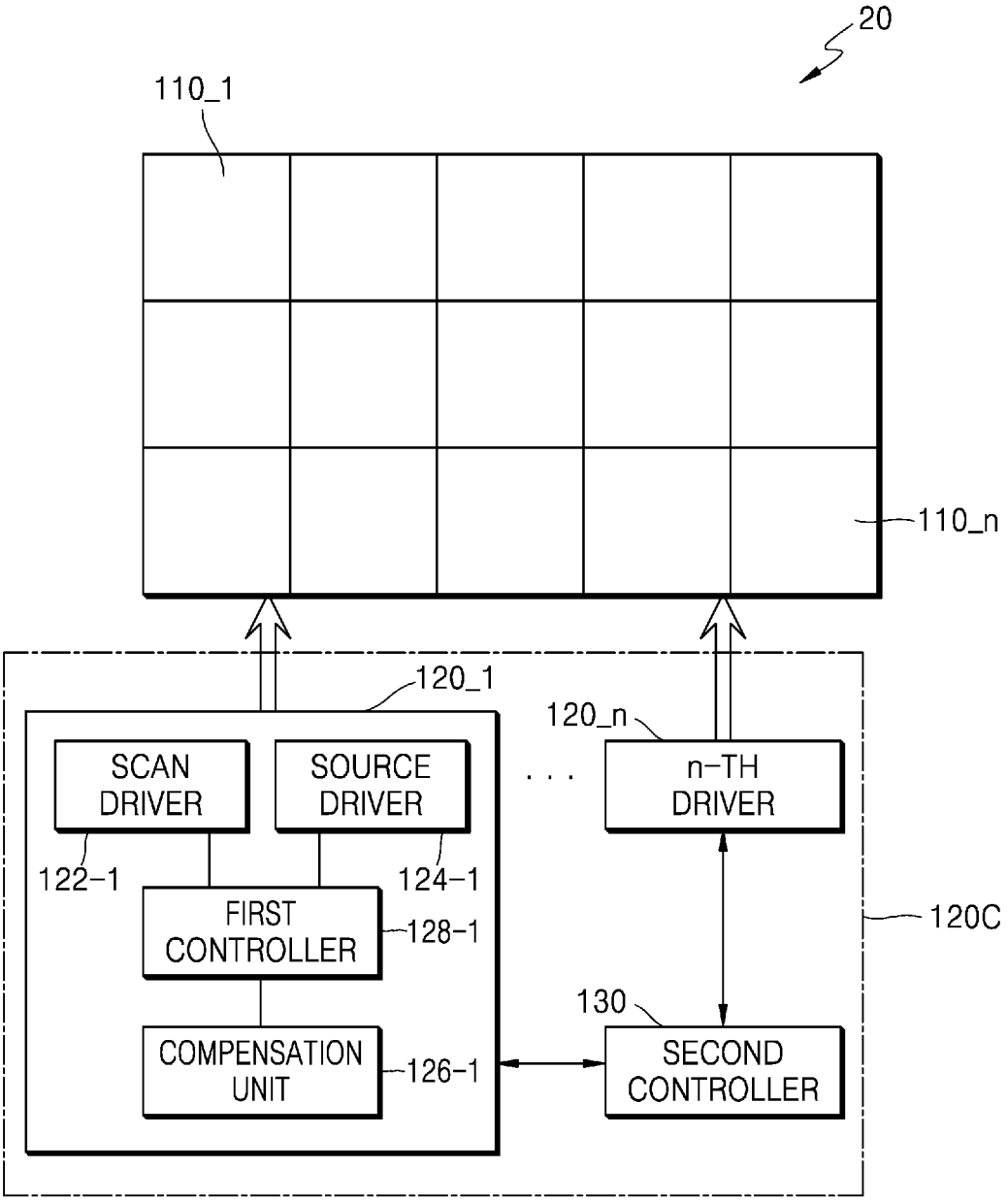
FIG. 10 is a schematic block diagram of a display device according to another embodiment of the present disclosure.

FIG. 10 is a block diagram of a display device according to another embodiment of the present disclosure.

Referring to FIG. 10, a display device 20 according to the embodiment may be a multi-display device in which a plurality of first to n-th display modules 110_1 to **110_*n* are arranged in connection with one another. A large-sized display device may be implemented through a combination of a plurality of display modules. The display device 20** may be used as an electronic board that displays commercial and public information indoors or outdoors such as a performance hall, an exhibition hall, a stock market, a department store, a hospital, a playground, a railroad, an airport, a highway, a house, etc.

The first to n-th display modules 110_1 to **110_*n* of the display device 20 may each independently display a separate image or may be combined to display one integrated image. Each of the first to n-th display modules 110_1 to 110_*n* may include the display unit 110 of the display device 10 shown in FIG. 1 or FIG. 3**.

The first to n-th display modules 110_1 to **110_*n* may be arranged in transverse and longitudinal directions at certain intervals. The first to n-th display modules 110_1 to 110_*n*** may be in contact with one another, or may be spaced apart from one another with a gap that is equal to or less than a width of a black matrix (not shown).

The first to n-th display modules 110_1 to **110_*n* may be arranged in the same sizes and/or same shapes. The first to n-th display modules 110_1 to 110_*n* may be arranged in a square, rectangular, or polygonal shape. In another example, at least one of the first to n-th display modules 110_1 to 110_*n*** may have a different size and/or different shape from the other.

The display device 20 may include a driver 120C controlling the first to n-th display modules 110_1 to **110_*n*. The driver 120C may include first to n-th drivers 120_1 to 120_*n* which respectively and independently control the first to n-th display modules 110_1 to 110_*n*, and a second controller 130 controlling the first to n-th drivers 120_1 to 120_*n***.

Each of the first to n-th drivers 120_1 to **120_*n* may include a scan driver 122_1, a source driver 124_1, a first controller 128_1, and a compensation unit 126_1. The elements included in each of the first to n-th drivers 120_1 to 120_*n* are the same as those of the driver 120A shown in FIG. 1, and detailed descriptions thereof are omitted. Each of the first to n-th drivers 120_1 to 120_*n* may further include a sensor, as in the driver 120B shown in FIG. 3**.

Each of the first to n-th drivers 120_1 to **120_*n* may perform brightness correction of each of the first to n-th display modules 110_1 to 110_*n*** corresponding thereto by the above-described method.

There may be a brightness variation among the first to n-th display modules 110_1 to **110_*n*. The second controller 130 may generate and provide brightness correction data from the first to n-th drivers 120_1 to 120_*n* for correcting the difference among the brightness of the first to n-th display modules 110_1 to 110_*n***.

Each of the first to n-th drivers 120_1 to **120_*n* displays a test image on the display module corresponding thereto from among the first to n-th display modules 110_1 to 110_*n*, and may perform compensation pixel extraction and compensation data generation. Input test image data input to each of the first to n-th display modules 110_1 to 110_*n* may be the same image data. Each of the first to n-th drivers 120_1 to 120_*n* may extract a compensation pixel based on a difference between a detected brightness of a pixel obtained from the test image and a first reference brightness and may generate compensation data in each of the first to n-th display modules 110_1 to 110_*n*** corresponding thereto. The first reference brightness may be a brightness of at least one adjacent pixel or a center brightness of the test image.

The second controller 130 may be provided with a global brightness (GB) of the test image displayed on the first to n-th display modules 110_1 to **110_*n* from the first to n-th drivers 120_1 to 120_*n***. The GB may be an average brightness of the test image or a center brightness in a brightness distribution chart of the test image.

The second controller 130 may generate GB correction data for correcting GB differences of the first to n-th display modules 110_1 to **110_*n* for each display module, and may provide the GB correction data to each of the first to n-th drivers 120_1 to 120_*n***. The GB correction data may be an offset value or a gain value with respect to entire pixels.

Each of the first to n-th drivers 120_1 to **120_*n* may correct the brightness of the input image data by using the compensation data CD and the brightness correction data. The first controller 128-1 of each of the first to n-th drivers 120_1 to 120_*n*** may convert the input image data DATA into corrected image data DATA' by using the compensation data CD and the brightness correction data.

The second controller 130 may generate brightness correction data for correcting the average brightness or the center brightness received from the first to n-th display modules 110_1 to **110_*n* by using a second reference brightness, for each display module, and then may provide the brightness correction data to each of the first to n-th drivers 120_1 to 120_*n*. The second reference brightness may be one of the average brightness or one of the center brightness of the first to n-th display modules 110_1 to 110_*n***. The second reference brightness may be an arbitrary brightness set by a user.

Figure 11:
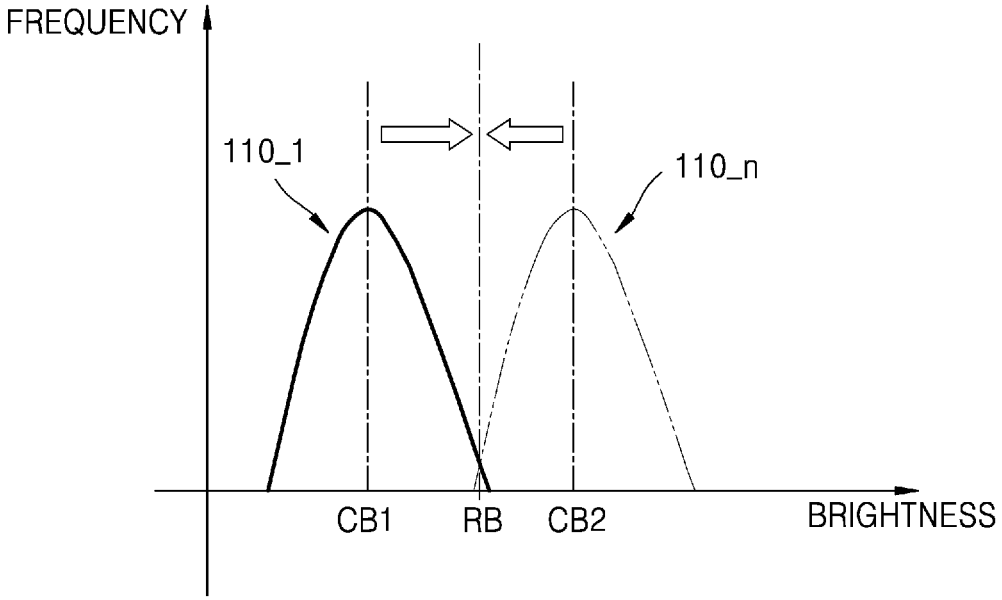
FIG. 11 is a brightness distribution diagram chart of a test image in each of a first display module and an n-th display module.

FIG. 11 is a brightness distribution chart of a test image in each of the first display module 110_1 and the n-th display module **110_*n*. A center brightness CB1 of the first display module 110_1 is different from a center brightness CB2 of the n-th display module 110_*n*. Therefore, the GB of the first display module 110_1 is different from that of the n-th display module 110_*n*, and there may be a brightness difference between the first display module 110_1 and the n-th display module 110_*n***.

The second controller 130 may generate brightness correction data for correcting the center brightness of the first to n-th display modules 110_1 to **110_*n* by using a reference center brightness RB, for each display module, and may provide the brightness correction data to each of the first to n-th drivers 120_1 to 120_*n*. The reference center brightness RB may be one of the center brightnesses CB of the first to n-th display modules 110_1 to 110_*n***. The reference center brightness RB may be an arbitrary brightness set by a user.

The display device 20 may ensure evenness in the brightness of the first to n-th display modules 110_1 to **110_*n* by correcting the brightness variation among the first to n-th display modules 110_1 to 110_*n***.

The display device 20 according to the embodiment of the present disclosure separately correct the brightness in each of the first to n-th display modules 110_1 to **110_*n*, and may evenly match the brightnesses of the first to n-th display modules 110_1 to 110_*n***.

The display devices 10 and 20 according to the embodiments of the present disclosure store the compensation data for correcting the brightness of a data signal in a built-in memory of the driver, and the built-in memory may only store the compensation data of some selected pixels, not the compensation data corresponding to all of the pixels of the display unit 110. As such, an issue of high costs may be addressed, wherein the issue occurs when a storage unit for storing brightness variation information of entire pixels in the display device and a storage unit for storing compensation data for each pixel are provided in addition to the driver 120. That is, according to embodiments of the present disclosure, a single memory may be built in the driver and a memory capacity is minimized, and thus, the demand for costs and miniaturization may be satisfied.

In the above-described embodiments, the brightness difference is calculated in the pixel unit, but the embodiments of the present disclosure are not limited thereto, that is, the brightness difference may be calculated in a block unit, wherein the block includes a certain number of pixels, and compensation data may be generated for a block having a brightness difference exceeding a reference value.

While the present disclosure has been particularly shown and described with reference to exemplary embodiments thereof, it will be understood by those of ordinary skill in the art that various changes in form and details may be made therein without departing from the spirit and scope as defined by the following claims. Therefore, the scope sought to be protected of the present disclosure shall be defined by the appended claims.

The invention claimed is:

1. A method of controlling a brightness in a display device, the method comprising:

applying input image data to a display unit including a plurality of pixels to display an image;

obtaining a measured brightness from each pixel of the image displayed on the display unit;

extracting compensation pixels each having a brightness difference exceeding a reference value, the brightness difference being a difference between the measured brightness and reference brightness; and generating compensation data of the compensation pixels based on the brightness difference of the compensation pixels, wherein the extracting of the compensation pixels comprises:

generating a brightness distribution chart of the image based on the measured brightness; and setting a center brightness value of the brightness distribution chart as the reference brightness, and wherein the brightness distribution chart represents a number of pixels for each brightness level and the center brightness value is a brightness level at which the number of pixels is the largest.

2. A display device comprising at least one processor to implement:

a first controller configured to apply input image data to a display unit including a plurality of pixels; and a compensation unit configured to obtain a measured brightness from each pixel of an image which is displayed on the display unit based on the input image data, extract compensation pixels each having a brightness difference exceeding a reference value, wherein the brightness difference is a difference between the measured brightness and reference brightness, and generate compensation data of the compensation pixels based on the brightness difference of the compensation pixels, wherein the compensation unit generates a brightness distribution chart of the image based on the measured brightness, sets a center brightness value of the brightness distribution chart as the reference brightness, and extracts pixels each having a brightness difference exceeding the reference value as the compensation pixels, the brightness difference being a difference between the measured brightness and the reference brightness, and wherein the brightness distribution chart represents a number of pixels for each brightness level and the center brightness value is a brightness level at which the number of pixels is the largest.

* * * * *